US005753837A

United States Patent [19]

Petillo et al.

[11] Patent Number: 5,753,837

[45] Date of Patent: May 19, 1998

[54] ADJUSTABLE REINFORCED NECK ASSEMBLY FOR STRINGED MUSICAL INSTRUMENT

[75] Inventors: Phillip J. Petillo, Ocean; Henry V. Vaccaro, Interlaken, both of N.J.

[73] Assignee: Kramer Music Industries, Inc., Neptune, N.J.

[21] Appl. No.: 603,815

[22] Filed: Feb. 20, 1996

Related U.S. Application Data

[60] Provisional application No. 60/008,173 Oct. 31, 1995.

[51] Int. Cl.[6] ..... G10D 3/00

[52] U.S. Cl. ..... 84/293; 84/267

[58] Field of Search ..... 84/293, 267

[56] References Cited

U.S. PATENT DOCUMENTS 1,652,627 12/1927 Jerome .

3,915,049 10/1975 Bean .

4,121,492 10/1978 Bernardi et al. .

4,200,023 4/1980 Kaman ..... 84/293

4,304,277 12/1981 Petillo .

5,465,642 11/1995 Goto ..... 84/293

*Primary Examiner*—Cassandra C. Spyrou

*Attorney, Agent, or Firm*—Plavy & Associates

[57] ABSTRACT

A neck assembly for a stringed musical instrument. The neck assembly includes an elongated reinforcing member having two flanges to prevent the neck assembly from bending. The neck assembly further includes a neck adjusting mechanism to unbend the neck assembly. The neck adjusting mechanism comprises a cable extending from the neck attaching end and the body attaching end and an adjustable fastener which is utilized to adjust the length of the cable. A musical instrument that employs the neck assembly of the present invention is also disclosed.

27 Claims, 13 Drawing Sheets

ADJUSTABLE REINFORCED NECK ASSEMBLY FOR STRINGED MUSICAL INSTRUMENT

RELATED APPLICATION

This application is related to provisional application number 60/008,173 filed on Oct. 31, 1995 entitled Adjustable Reinforced Neck Assembly for Stringed Musical Instrument.

FIELD OF THE INVENTION

This invention relates generally to stringed musical instruments and specifically to a neck assembly for a stringed musical instrument that includes an improved reinforcing member.

BACKGROUND OF THE INVENTION

Stringed instruments are typically divided into two categories, either bowed instruments such as violins or plucked instruments such as guitars. Such instruments usually comprise a body, a neck assembly extending from the body, a head fastened to the other end of the neck assembly, and a set of strings that extend from a plurality of tuning keys located on the head to a string fastening means located on the body of the instrument. As a result, when the strings are strummed or plucked, the body of the instrument resonates and produces sound.

However, both categories of instruments suffer from the same problem. The strings impose large, tensile forces on the neck, thereby causing warping and twisting of the neck. Further, as the instrument is tuned, the strings are further stretched, thereby imposing extensive longitudinal stressing over the neck and body of the instrument. Thus, if this stress is not adequately controlled or resisted, warping and twisting of the neck will occur. As a result, the instrument will produce distorted notes when played. In fact, this warping and twisting can become so great that the strings can contact the neck in undesirable locations, thereby rendering the instrument unplayable.

Several attempts have been made at reinforcing the necks of stringed instruments in order to prevent and/or reduce the warping and twisting of the neck. For example, U.S. Pat. No. 1,652,627 to Jerome discloses a guitar neck having a steel rod incorporated therein. However, the steel rod does not successfully prevent or reduce the warping of the neck. Furthermore, the steel rod acts as a resonant member and produces undesirable frequencies which adversely affect the sound quality of the instrument.

In another prior art patent, U.S. Pat. No. 3,915,049 to Bean, a neck made entirely of aluminum is employed. While necks made of metal are feasible, players of stringed instruments are accustomed to the feel of wood. As such, such metallic necks are often cold and uncomfortable. Furthermore, such metal necks interfere with the harmonics of the instrument. Finally, such metal necks are subject to the formation of oxides, which rub off on the hand of the player.

In yet another prior art patent, U.S. Pat. No. 4,121,492 to Berardi et al., a T-shaped reinforcing member comprising a top crosspiece and a depending leg is fastened to the body of an instrument. A fingerboard member is attached to the top of the crosspiece and inserts are attached on both sides of the leg to produce a neck structure having a semicircular cross-section.

In a similar patent, U.S. Pat. No. 4,304,277 to Petillo, two L-shaped reinforcing members are joined with a non-metallic spacing element and several grip members to form a reinforced neck for a musical instrument.

As can be seen, none of these devices provide a stringed instrument having a neck with little or no warpage under normal use. Further, these prior art reinforcing structures suffer from the fact that in the event of warpage, the bending of neck can not be easily corrected.

Accordingly, the object of this invention is to provide an adjustable reinforced neck assembly for a stringed instrument that is substantially resistant to neck warpage, that is correctable in the event that some small amount of warpage occurs, that does not produce unwanted sound distortions, and that is easy and inexpensive to manufacture.

SUMMARY OF THE INVENTION

The present invention is a neck assembly for a stringed musical instrument. The neck assembly includes an elongated reinforcing member having two flanges to prevent the neck assembly from bending. The neck assembly further includes a neck adjusting mechanism to unbend the neck assembly. The neck adjusting mechanism comprises a cable extending from the neck attaching end and the body attaching end and an adjustable fastener which is utilized to adjust the length of the cable. A musical instrument that employs the neck assembly of the present invention is also disclosed.

BRIEF DESCRIPTION OF THE DRAWINGS

The foregoing and other objects, features, and advantages of the invention will be apparent from the following description of the preferred embodiments of the invention, as illustrated in the accompanying drawings, wherein.

DETAILED DESCRIPTION OF THE DRAWINGS

The present invention is directed to an adjustable reinforced neck assembly for a stringed musical instrument. Although the invention has particular application to guitars, which are fretted instruments, it will be appreciated that violins, violas, cellos, and other stringed instruments with plain fingerboards may employ the inventive features with equally improved results.

Figure 1:
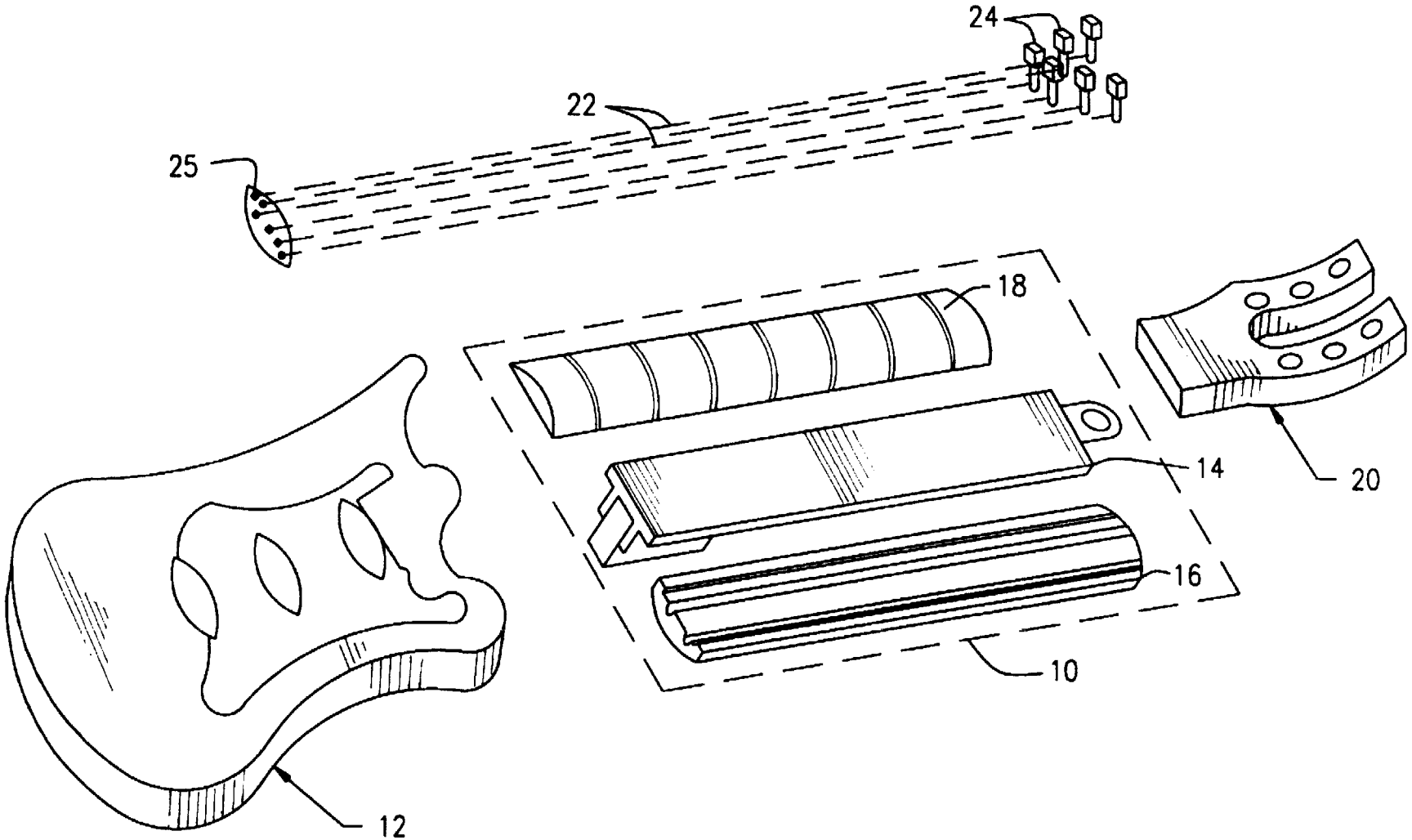
FIG. 1 an exploded view of an electric guitar incorporating the adjustable reinforced neck assembly of the present invention.

Referring now to FIG. 1, the adjustable reinforced neck assembly 10 of the present invention is shown coupled between a body 12 and head 20 of an electric guitar. The neck assembly 10 comprises an elongated double flanged member 14 which is sandwiched between an elongated grip portion 16 and a fingerboard 18. Strings 22 extend from a plurality of tuning keys 24 located on the guitar head 20 to a string fastening means 26 located on the guitar body 12.

Figure 2:
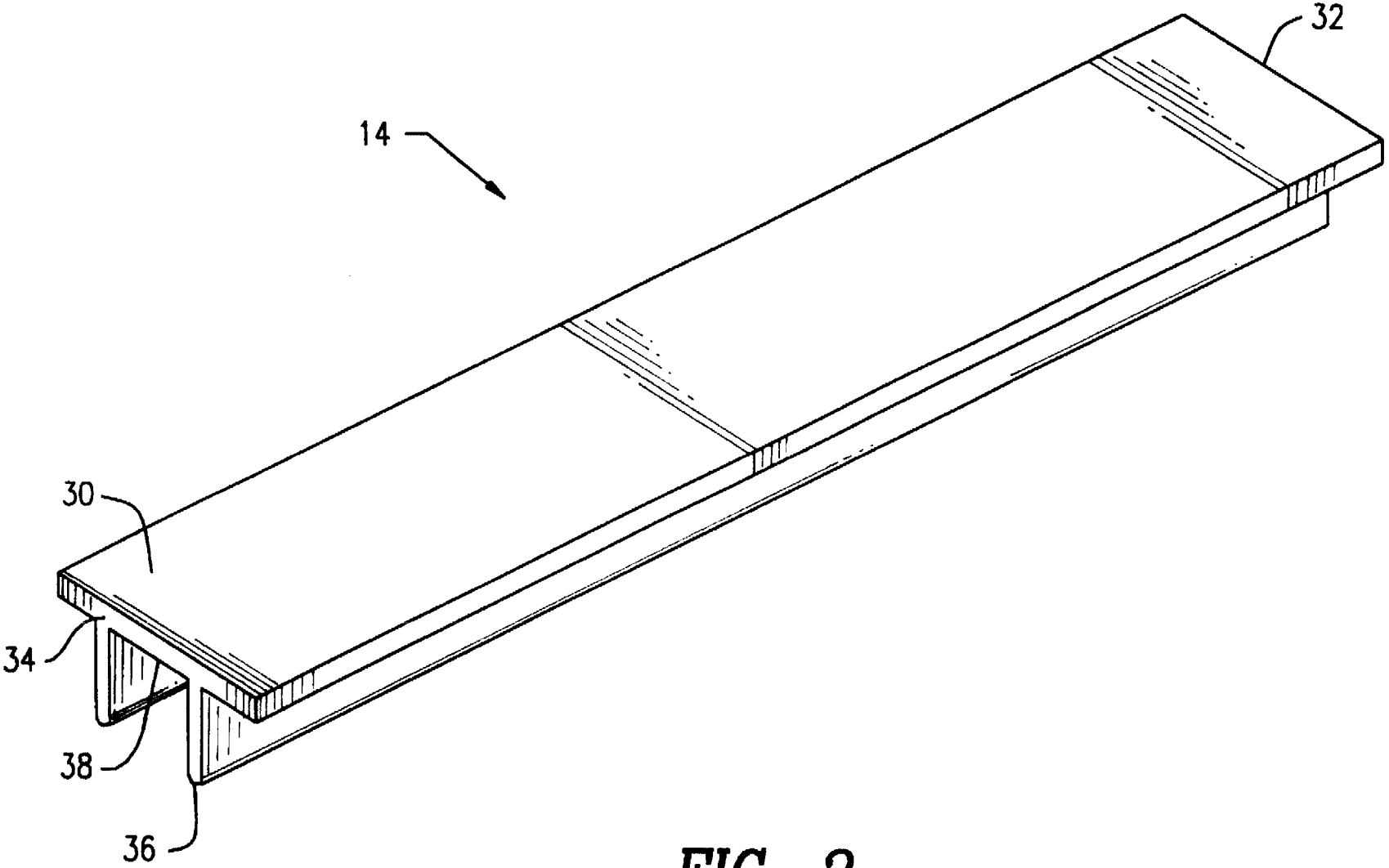
FIG. 2 is a perspective view of the double flanged member shown in FIG. 1.

Referring to FIG. 2, the double flanged member 14 is shown comprising a top crosspiece 30, a head attaching end 32, a body attaching end 34, and two integrally formed reinforcing flanges 36 extending along the length of the crosspiece 30 from the head attaching end 32 to the body attaching end 34. The two reinforcing flanges 36 define a groove 38 which extends along the length of the crosspiece 30.

The double flanged member 14 is formed via conventional extrusion techniques from aircraft aluminum, although any other suitable material can be used. The flanges 36 of the double flanged member 14 are sufficiently spaced apart the width of the crosspiece 30 such that the member 14 resists the torsional forces associated with warping and the longitudinal forces imparted to the neck assembly 10 when the strings 22 (shown in FIG. 1) of the instrument are tightened and tuned. However, it should be understood that the double flanged member 14 is not limited as described herein. For example, the tonal quality and the sustaining quality of the instrument can be modified by altering the configuration of the double flanged member 14 shown in FIG. 2.

Figure 3:
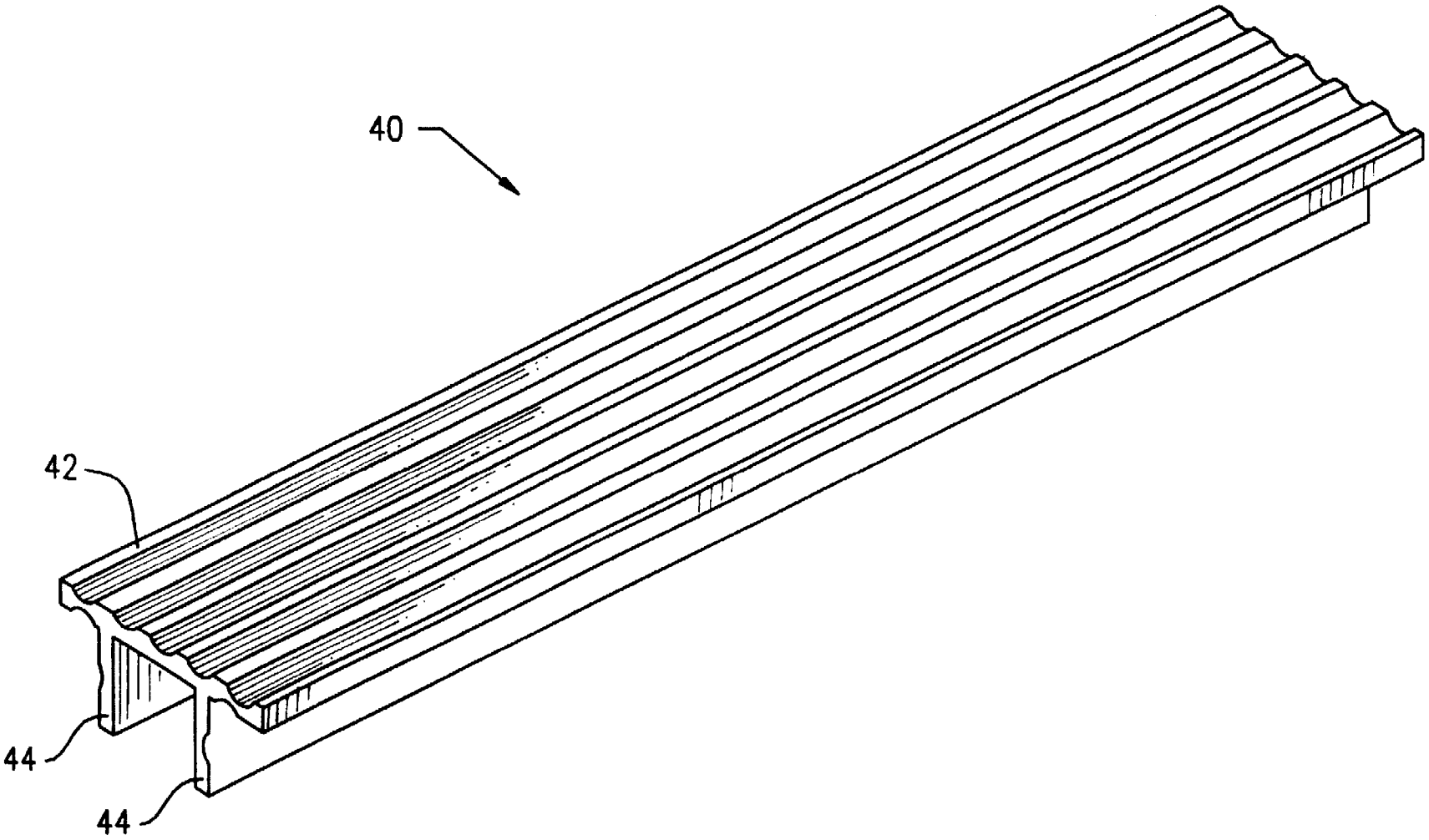
FIG. 3 is a perspective view of another embodiment of the double flanged member shown in FIG. 1.

Referring to FIG. 3, another exemplary embodiment 40 of the double flanged member is shown. In this embodiment, the top crosspiece 42 and the flanges 44 of the neck 40 are ribbed to further reinforce the neck assembly against warping, bending, and twisting resulting from the tension imparted to the neck assembly from the strings 22 (shown in FIG. 1).

Figure 4:
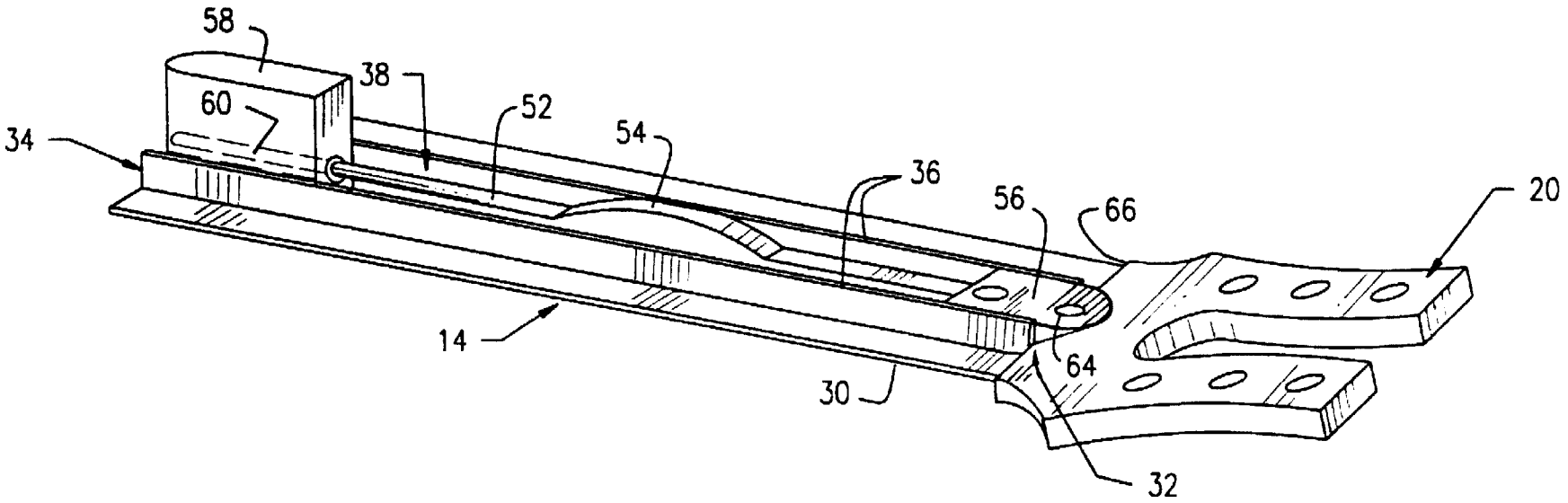
FIG. 4 is a perspective view of the double flanged member shown in FIG. 2 having a neck adjusting means.

Referring to FIG. 4, the double flanged member 14 is shown with an optional neck adjusting mechanism disposed between the reinforcing flanges 36 of the double flanged member 14 for correcting any effects of warping of the neck assembly 10 (shown in FIG. 1). The neck adjusting mechanism generally comprises an adjustable length of cable 52 secured at both the body attaching end 34 and the head attaching end 32 and a loading block 54 positioned in the groove 38 between the cable 52 and the crosspiece 30.

A first metal block 56 is located adjacent to the head connecting end 32 of the double flanged member 14 and is permanently affixed within the groove 38 defined by the flanges 36. The block 56 secures one end of the cable 52 to the double flanged member 14. A second metal block 58 is located adjacent to the body connecting end 34 of the double flanged member 14 and is permanently affixed within the groove 38 defined by the flanges 36. The block 58 secures the other end of the cable 52 to the double flanged member 14. The length of cable 52 runs along the length of the double flanged member 14 and within the groove 38 defined by the flanges 36 and contacts the loading block 54. Finally, an adjustable fastener (not shown) is disposed within an aperture 60 (shown with dotted lines) formed in the second metal block 58 for adjusting the length of the cable 52.

Thus, any warping of the neck assembly 10 (shown in FIG. 1) can be corrected by shortening the length of the cable 52 which places the double flanged member 14 and therefore the neck assembly 10 in tension to unbend the neck assembly 10. As the cable 52 is shortened, it applies a force to the loading block 54. The loading block 54 transfers this force to the crosspiece 30 of the double flanged member 14, thereby bending the neck assembly 10 in a direction opposite to the direction of the warping. This procedure can be repeated until the warping is corrected. It should be understood that the neck adjusting mechanism is not limited to the embodiment described herein and can include other similar neck adjusting mechanisms which bend the neck assembly in a direction opposite to the direction of warping.

Figure 5:
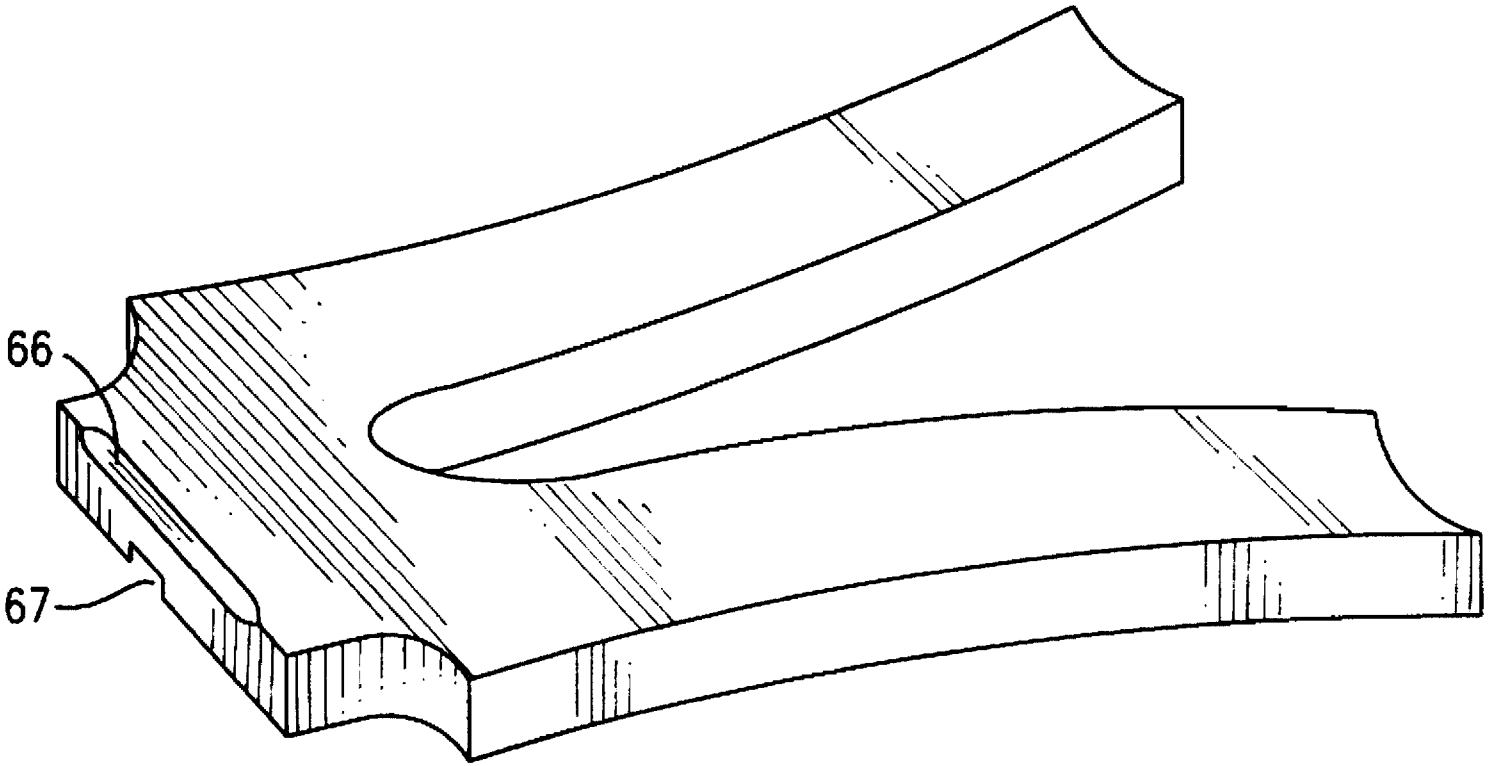
FIG. 5 is a perspective view of another embodiment of the guitar head shown in FIG. 1.
Figure 6:
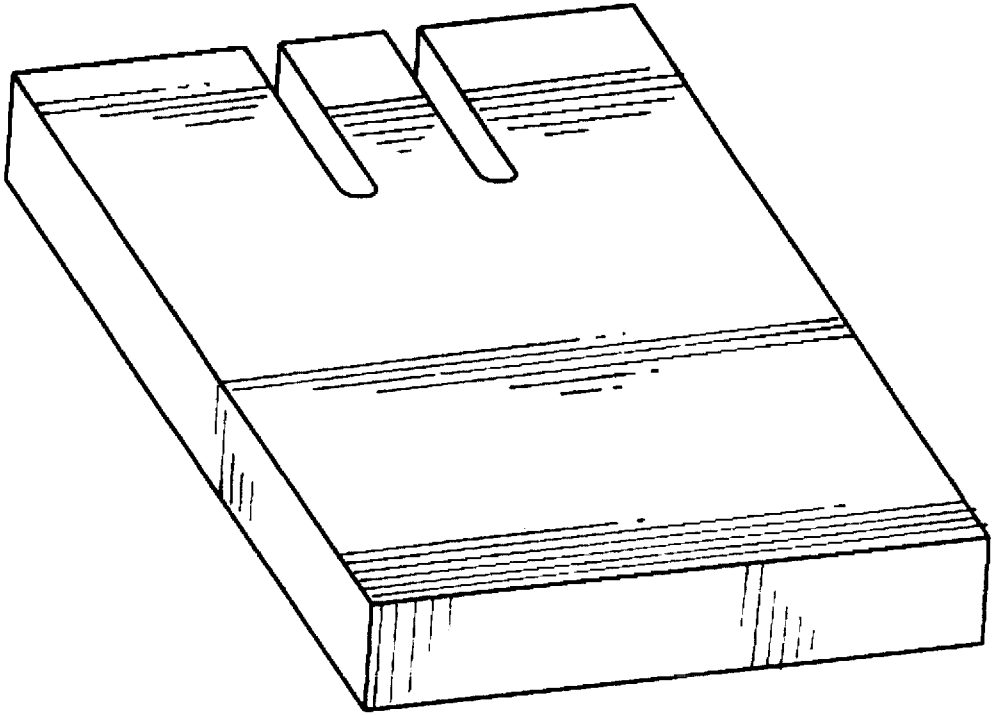
FIG. 6 is a perspective view of still another embodiment of the guitar head shown in FIG. 1.
Figure 7:
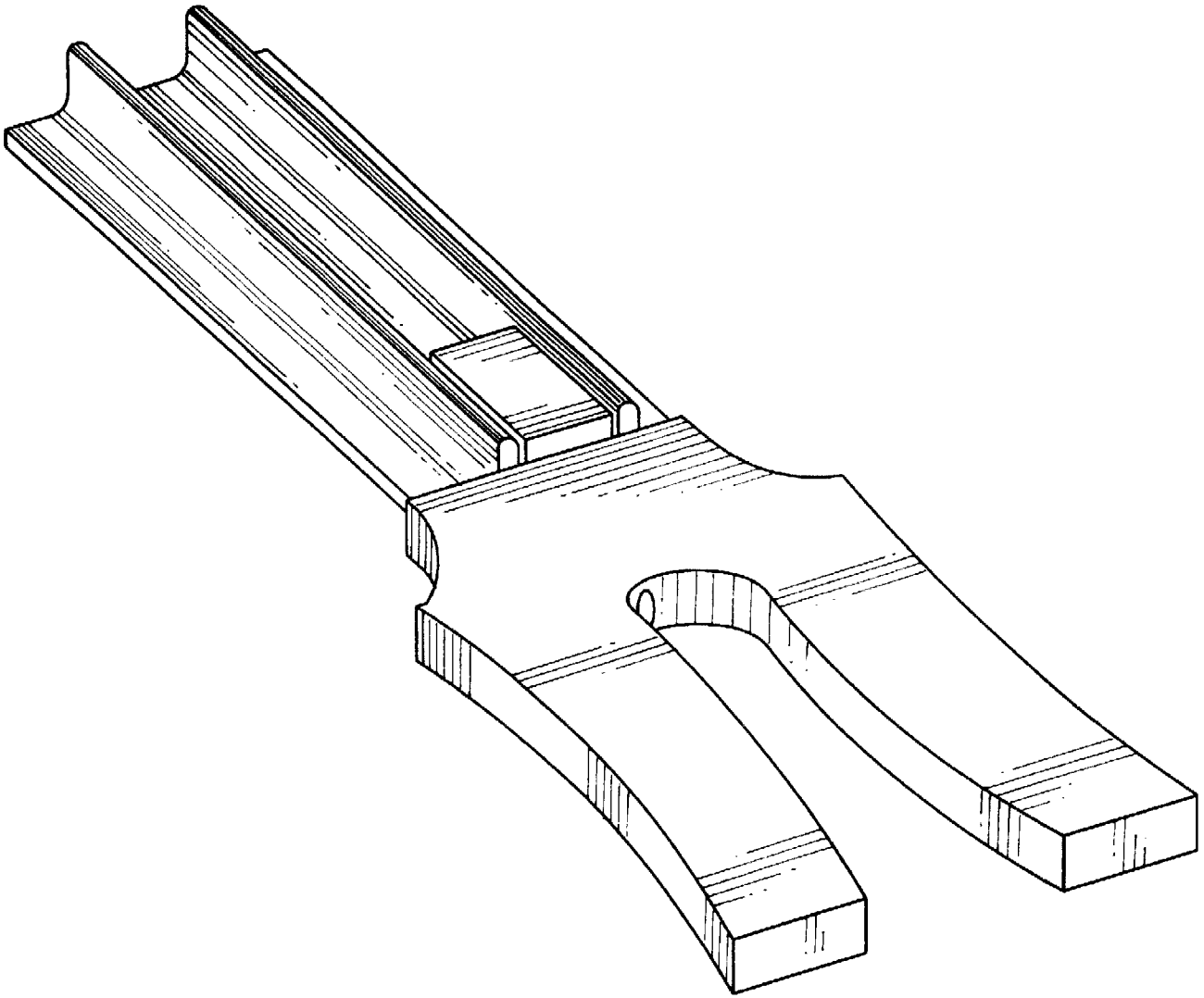
FIG. 7 is a perspective view of the double flanged member shown in FIG. 2 coupled to a guitar head via an adjustable screw.
Figure 8:
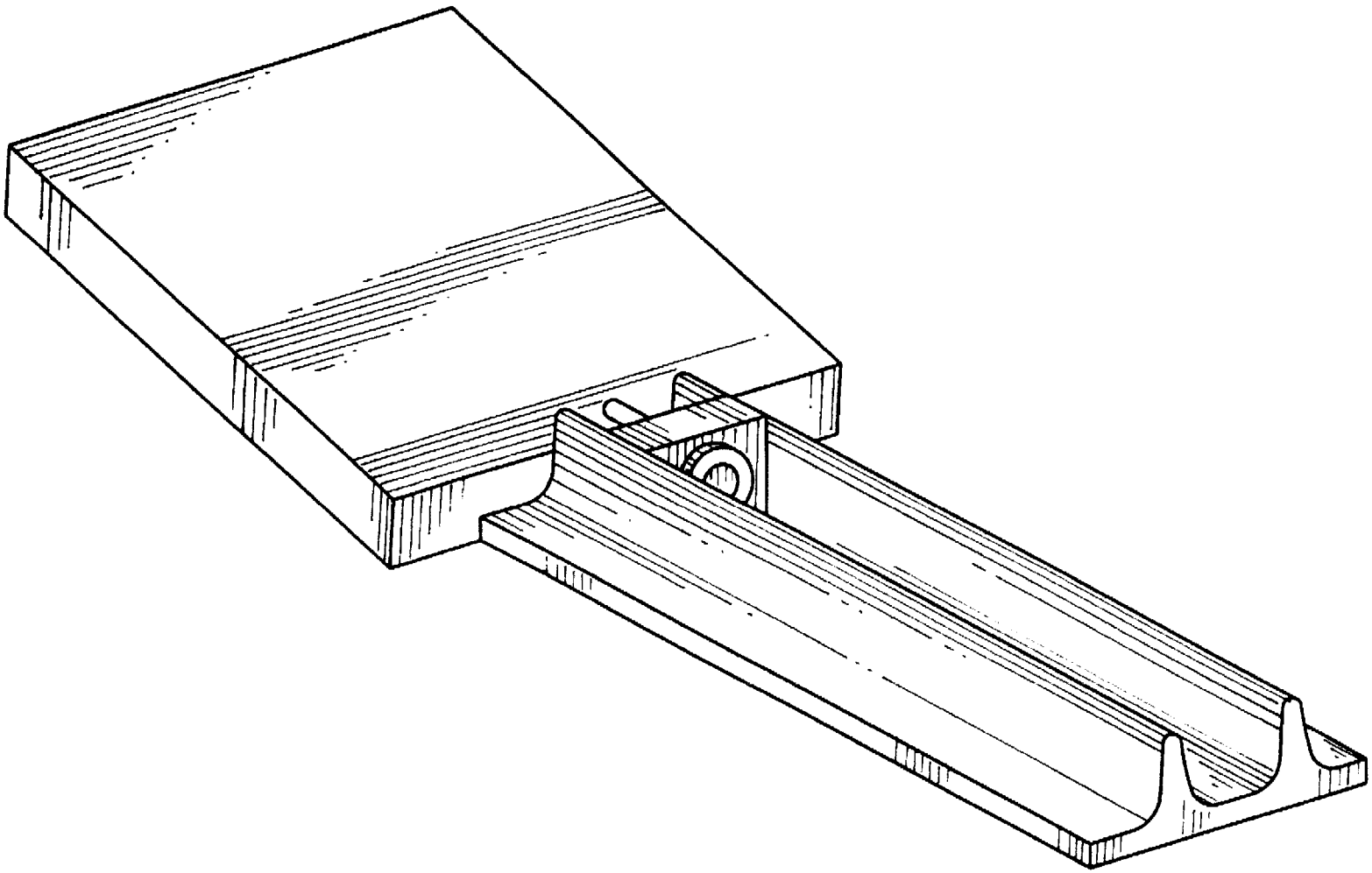
FIG. 8 is a perspective view of the double flanged member shown in FIG. 2 coupled to a guitar head via a screw.

Still referring to FIG. 4, the guitar head 20 is shown attached to the head attaching end 32 of the neck assembly 14. The guitar head 20 is generally shown as a forked member which reduces the weight of the head. Further, the head 20 is also constructed from a conventional aircraft aluminum, although other suitable materials can be used. It should be understood that the head 20 is not limited as shown and can comprise other shapes. For example, FIGS. 5 and 6 illustrate other embodiments of guitar heads.

Figure 9:
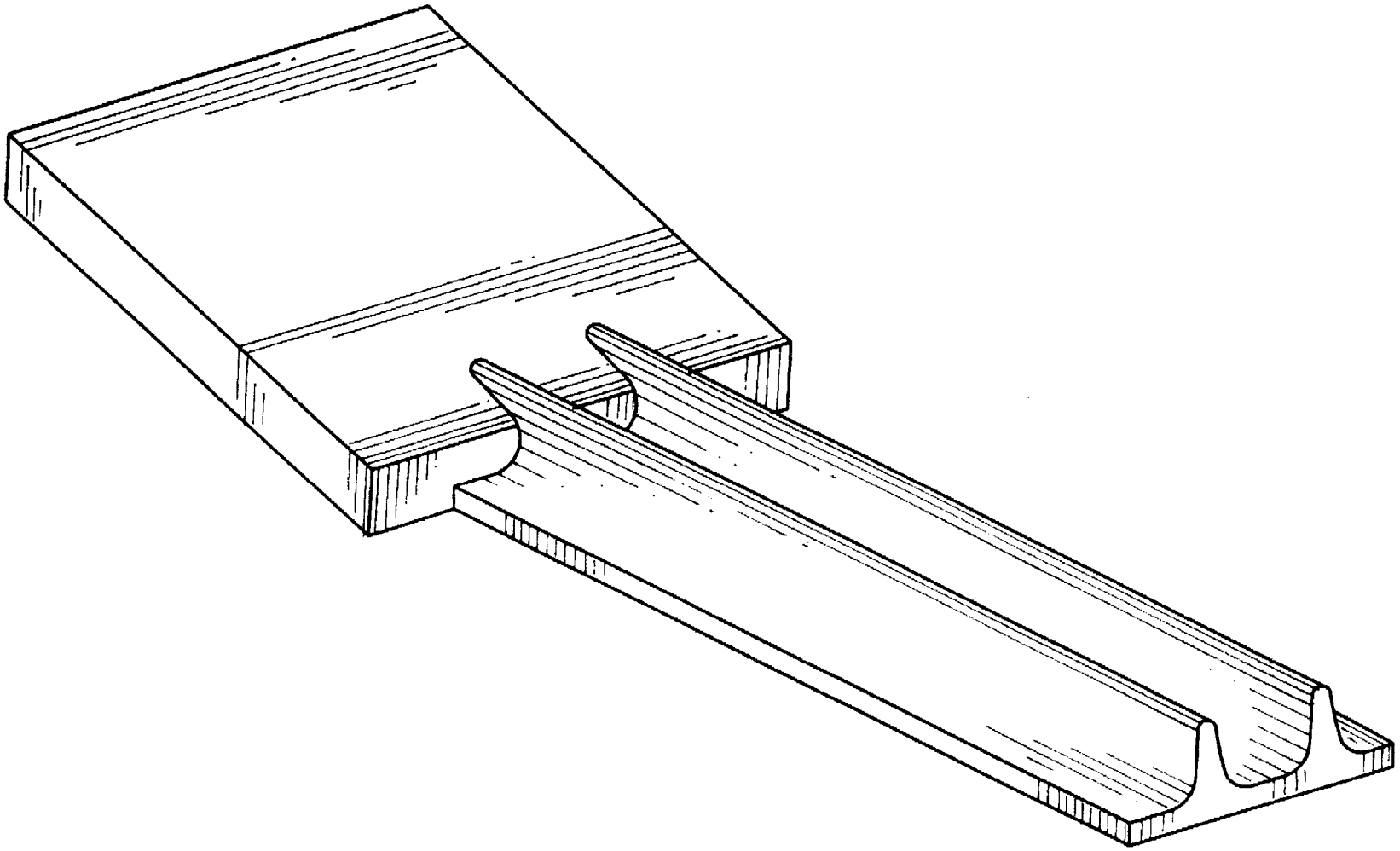
FIG. 9 is a perspective view of another embodiment of the double flanged member shown in FIG. 2 coupled to a guitar head.
Figure 10:
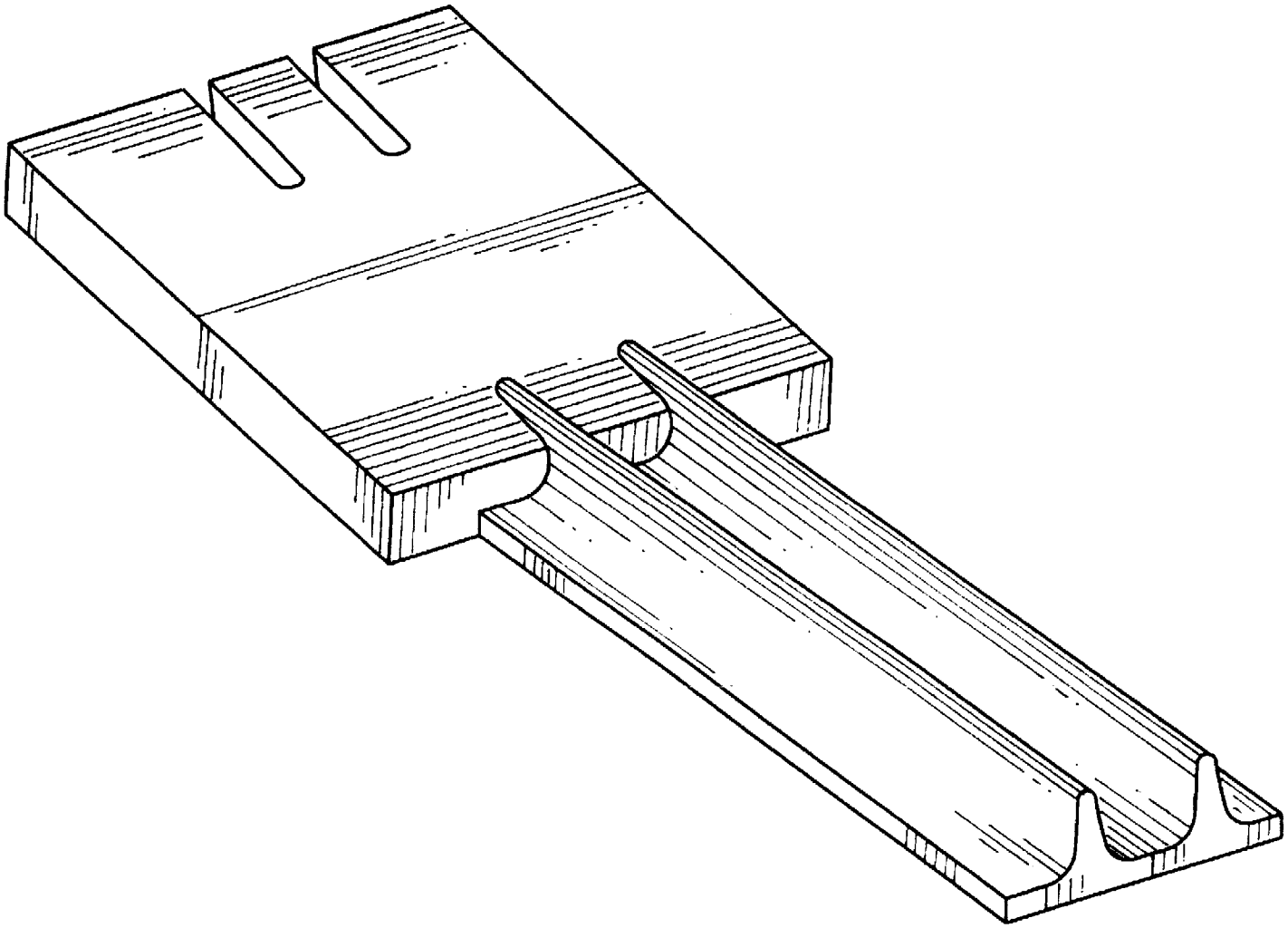
FIG. 10 is a perspective view of the double flanged member shown in FIG. 9 coupled to another embodiment of the guitar head.
Figure 11:
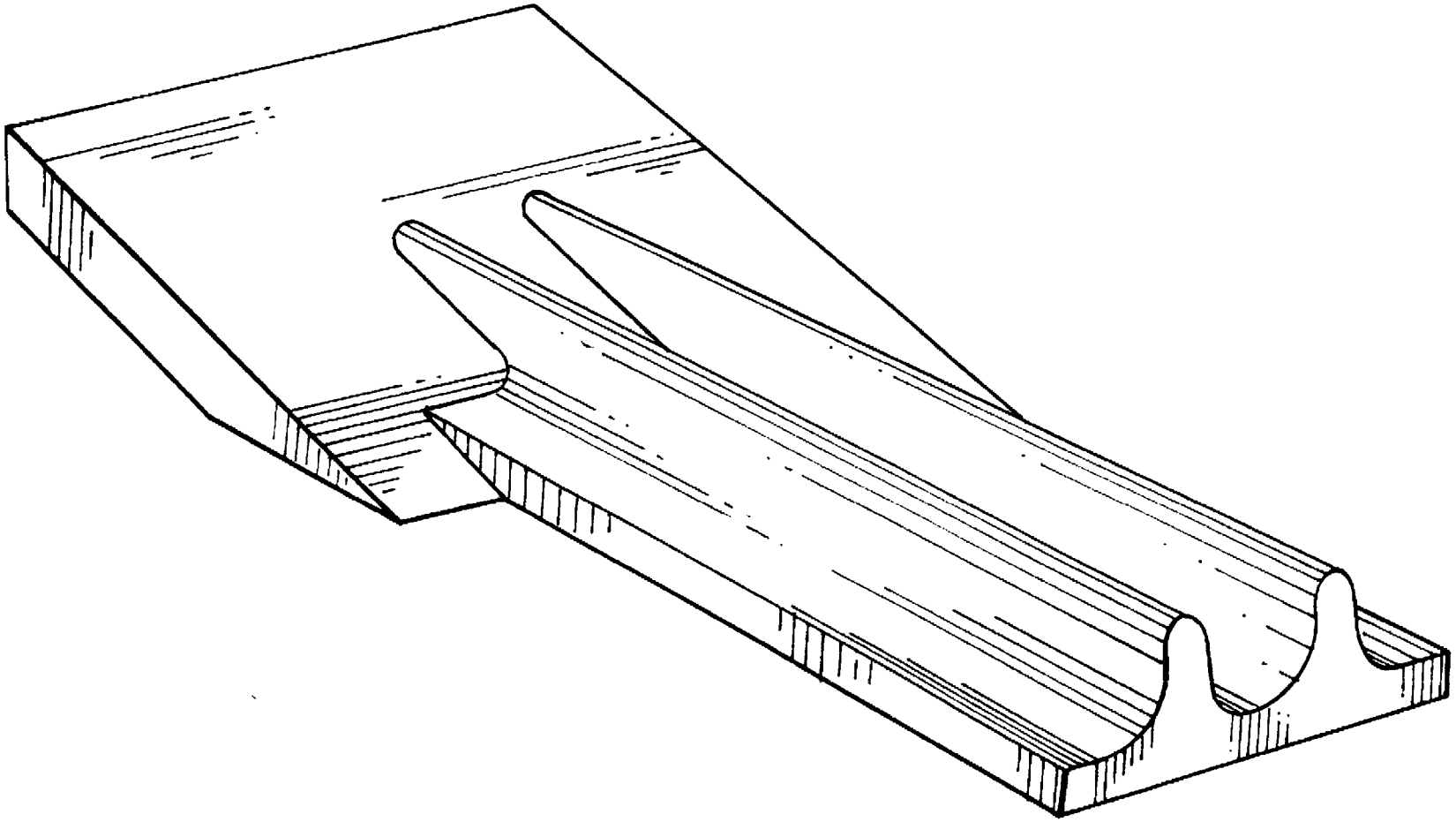
FIG. 11 is a perspective view of another embodiment of the double flanged member shown in FIG. 2 coupled to a guitar head.

As shown in FIG. 4, the head 20 is fastened to the head attaching end 32 of the double flanged member 14 via a rivet 64. The head 20 includes a beveled surface 66 which is best seen in FIG. 5, that enables the head 20 to be angularly joined with the double flanged member 14. Also visible in FIG. 5 is a cut out 67 which operates in conjunction with the beveled surface 66 to enable the head 20 to be welded to the double flanged member if so desired. FIGS. 7–11 which illustrate other methods for coupling the head to double flanged member. In particular, in FIGS. 7 and 8, the head is shown secured to the double flanged member using threaded fasteners. In FIGS. 9–11, the head is shown secured to the double flanged member by welding the two components together.

Figure 12:
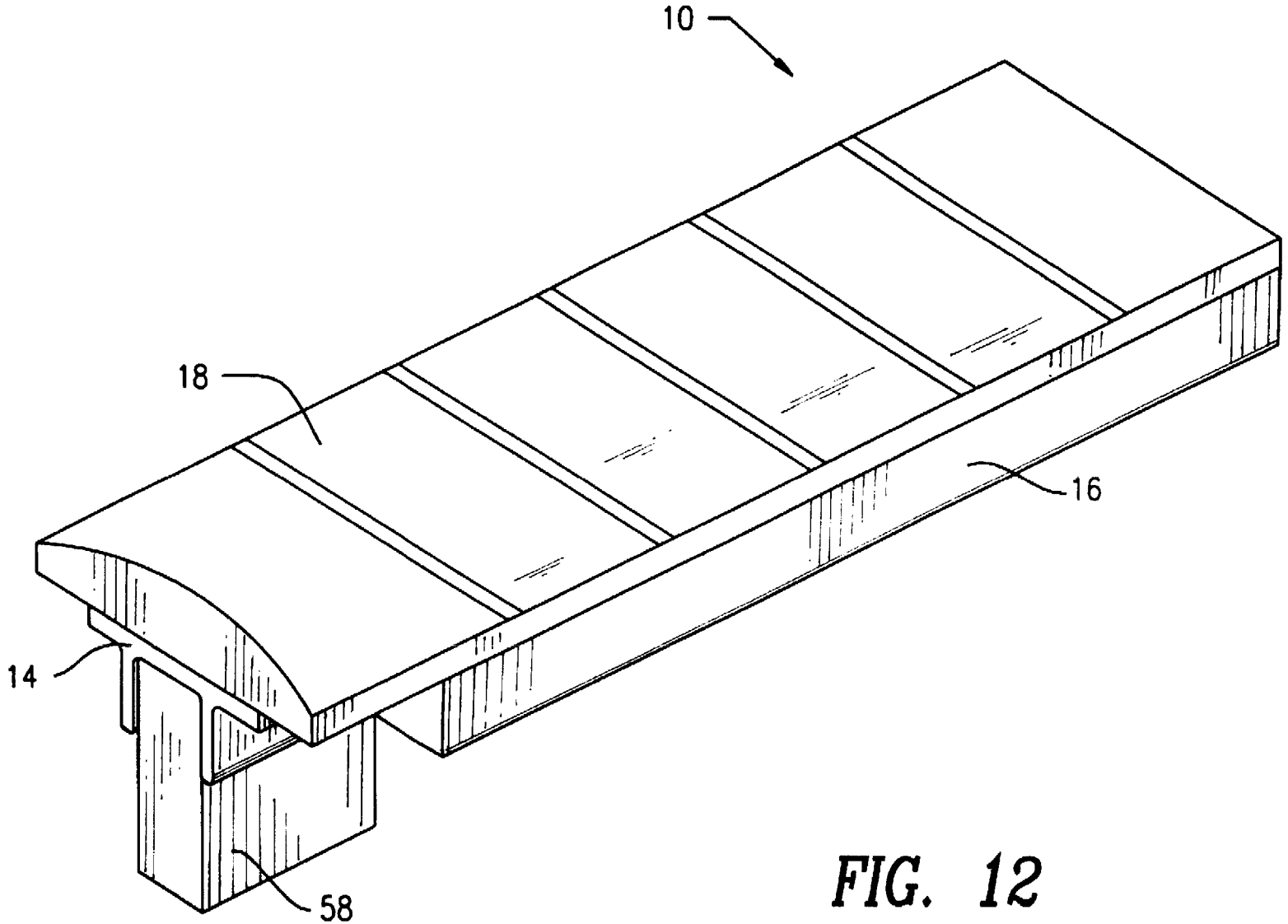
FIG. 12 is a perspective view of the adjustable reinforced neck assembly of the present invention.
Figure 13:
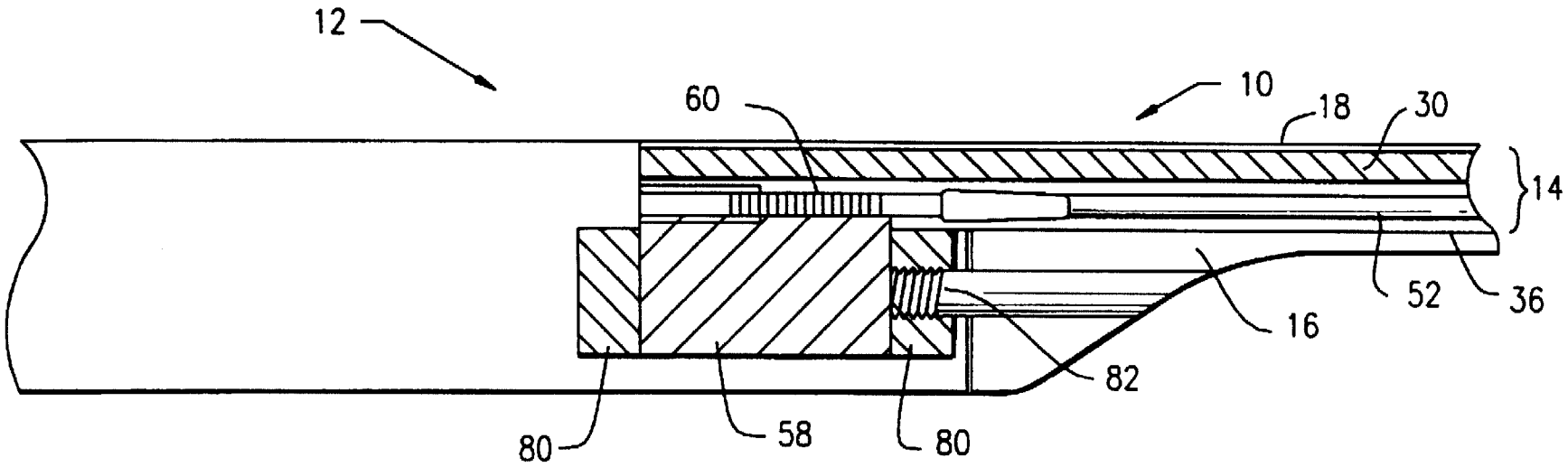
FIG. 13 is a partial cross-sectional view showing the adjustable reinforced neck assembly connected to a guitar body.

Referring to FIGS. 12 and 13, the double flanged member 14 is sandwiched between the grip member 16 and the fingerboard 18 of the neck assembly 10. As shown in FIG. 12, the grip member 16 does not enclose the block 58 of the double flanged member 14. Further, the grip member 16 and the finger board are preferably made from a hard wood such as maple, oak, teak or rosewood. The grip member 16 and the finger board 18 can also be fabricated from a plastic or a composite material. FIG. 13, shows the adjustable reinforced neck assembly 10 coupled to the guitar body 12. The exposed block 58 on the neck assembly 10 is secured within a substantially rectangular shaped metal collar 80 affixed to the inside of the guitar body 12. A set-screw 82 prevents the block 58 from slipping out of the collar 80.

Accordingly, the adjustable reinforced neck assembly of the present invention is stronger and substantially resistant to neck warpage, as compared to those structures of the prior art.

In addition, the adjustable reinforced neck assembly of the present invention is correctable in the event of warping or twisting of the neck.

Further, the adjustable reinforced neck assembly of the present invention produces a higher quality of sound as compared to those necks of the prior art. For instance, the necks of the prior art that incorporate solid rods to prevent warpage often act as resonant members and generate undesirable frequencies, which adversely affect the quality of the sound produced by the instrument. Unlike the prior art, the present invention employs a cable which does not produce such frequencies.

Still further, the adjustable reinforced neck assembly of the present invention is programmable. More particularly, the tonal quality and the sustaining quality of the instrument can be varied by changing the configuration of the neck assembly.

Finally, the adjustable reinforced neck assembly of the present invention is easier and less expensive to make as compared to those necks of the prior art.

It will be understood that the embodiments described herein are merely exemplary and that a person skilled in the art may variations and modifications to these embodiments utilizing functionally equivalent elements to those described herein. Any and all such modifications as well as others which may be apparent to those skilled in the art are intended to be included within the scope of the present invention as defined by the appended claims.

What is claimed is:

1. A neck assembly for a stringed musical instrument, comprising:

an elongated reinforcing member including a crosspiece having two parallel edges and a substantially planar surface extending therebetween, and two flanges depending from said surface of said crosspiece, said two flanges extending along said surface of said crosspiece and spaced from and extending parallel to said edges thereof, whereby said reinforcing member substantially prevents said neck assembly from bending.

2. The neck assembly of claim 1 wherein said flanges define a groove therebetween.

3. The neck assembly of claim 1 wherein said flanges extend from a head attaching end to an instrument body attaching end of said reinforcing member.

4. The neck assembly of claim 1 wherein said crosspiece of said elongated reinforcing member includes a plurality of ribs to further prevent said neck assembly from bending.

5. The neck assembly of claim 4 wherein said ribs are disposed on a second surface of said crosspiece.

6. The neck assembly of claim 1 wherein a plurality of ribs are disposed on each of said flanges.

7. The neck assembly of claim 1 wherein a first plurality of ribs are disposed on each of said flanges and a second plurality of ribs are disposed on a second surface of said crosspiece.

8. The neck assembly of claim 7 wherein at least one of said first and second plurality of ribs extends from a head attaching end to an instrument body attaching end of said reinforcing member.

9. The neck assembly of claim 1 which further includes neck adjusting means to unbend said neck assembly.

10. The neck assembly of claim 9 wherein said neck adjusting means includes a cable secured to a head attaching end and an instrument body attaching end of said reinforcing member to unbend said neck assembly.

11. The neck assembly of claim 10 wherein said cable includes an adjustable fastener connected to said cable for adjusting the length of said cable to unbend said neck assembly.

12. The neck assembly of claim 9 wherein said neck adjusting means further includes means disposed between said cable and a surface of said elongated reinforcing member for transferring a vertical force from said cable to said neck assembly to unbend said neck assembly.

13. The neck assembly of claim 9 wherein said neck adjusting means further includes means for attaching said reinforcing member to a body of the musical instrument.

14. The stringed musical instrument of claim 13 wherein said flanges extend from a head attaching end to an instrument body attaching end of said reinforcing member.

15. A stringed musical instrument comprising:

a musical instrument body;

a neck assembly that includes an elongated reinforcing member including a crosspiece having two parallel edges and a substantially planar surface extending therebetween and two flanges depending from said surface of said crosspiece, said flanges extending along said surface of said crosspiece and spaced from and extending parallel to said edges thereof, whereby said reinforcing member substantially prevents said neck assembly from bending.

16. The stringed musical instrument of claim 15 wherein said flanges define a groove therebetween.

17. The stringed musical instrument of claim 15 wherein said crosspiece of said elongated reinforcing member includes a plurality of ribs to further prevent said neck assembly from bending.

18. The stringed musical instrument of claim 17 wherein said ribs are disposed on a second surface of said crosspiece.

19. The stringed musical instrument of claim 15 wherein a plurality of ribs are disposed on each of said flanges.

20. The stringed musical instrument of claim 15 wherein a first plurality of ribs are disposed on each of said flanges and a second plurality of ribs are disposed on a second surface of said crosspiece.

21. The stringed musical instrument of claim 20 wherein at least one of said first and second plurality of ribs extends from a head attaching end to an instrument body attaching end of said reinforcing member.

22. The stringed musical instrument of claim 15, which further includes neck adjusting means to unbend said neck assembly.

23. The stringed musical instrument of claim 22 wherein said neck adjusting means includes a cable secured to a head adjusting end and an instrument body attaching end of said reinforcing member.

24. The stringed musical instrument of claim 23 wherein said cable includes an adjustable fastener connected to said cable for adjusting the length of said cable to unbend said neck assembly.

25. The stringed musical instrument of claim 23 wherein said neck adjusting means further includes means between said cable and said surface of said elongated reinforcing member for transferring a vertical force from said cable to said neck assembly to unbend said neck assembly.

26. The stringed musical instrument of claim 22 wherein said neck adjusting means further includes means for attaching said reinforcing member to said body of said stringed musical instrument.

27. The stringed musical instrument of claim 15 wherein said stringed musical instrument is a guitar.

* * * * *